US006530494B1

(12) United States Patent
Chen

(10) Patent No.: US 6,530,494 B1
(45) Date of Patent: Mar. 11, 2003

(54) FOLDING COLLAPSIBLE BOTTLE BASKET

(75) Inventor: Shyan-Wei Chen, Taipei Hsien (TW)

(73) Assignee: Racer Sporting Goods Co., Ltd., Taipei Hsien (TW)

( * ) Notice: Subject to any disclaimer, the term of this patent is extended or adjusted under 35 U.S.C. 154(b) by 0 days.

(21) Appl. No.: 10/187,296

(22) Filed: Jul. 2, 2002

(51) Int. Cl.[7] ..... B65D 6/08
(52) U.S. Cl. ..... 220/485; 220/9.2
(58) Field of Search ..... 220/485, 489, 220/9.2, 9.3, 495

(56) References Cited

U.S. PATENT DOCUMENTS 3,410,328 A * 11/1968 Hideo ..... 220/9.2
3,868,155 A * 2/1975 Cherubini ..... 135/132
4,074,826 A * 2/1978 Lewanoni ..... 220/6
4,299,365 A * 11/1981 Battle ..... 248/99
6,354,455 B1 * 3/2002 Chen ..... 220/489

* cited by examiner

*Primary Examiner*—Joseph M. Moy
(74) *Attorney, Agent, or Firm*—Troxell Law Office PLLC

(57) ABSTRACT

A folding collapsible bottle basket is constructed to include a rectangular open top frame, the top frame having two parallel stretchers, the stretchers each having an insertion hole on the middle, a bottom frame, the bottom frame having a frame body and two sliding tracks spaced below the frame body, two side frames inserted through the gap between the frame body and sliding tracks of the bottom frame and pivoted to the top frame and moved along the sliding tracks between the operative position and the non-operative position, stop means provided at the sliding tracks and adapted for holding the side frames in the operative position, and a handle pivoted to the top frame, the handle having two straight end rod portions inserted through the insertion holes of the stretchers and respectively pivoted to two opposite short sides of the top frame and a Π-shaped middle handgrip portion connected between the straight end rod portions.

2 Claims, 4 Drawing Sheets

FOLDING COLLAPSIBLE BOTTLE BASKET

BACKGROUND AND SUMMARY OF THE INVENTION

The present invention relates to a bottle basket for carrying bottles or the like and, more particularly, to such a bottle basket, which is folding collapsible.

U.S. Pat. No. 6,354,455, issued to the present inventor, discloses a bottle basket that is folding collapsible. When not in use, the user can collapse the bottle basket to minimize space occupation. This folding collapsible bottle basket is functional, however it still has drawbacks as outlined hereinafter.

1. The user must disconnect the handle from the respective pivot holes in the bottom frame before collapsing the bottle basket. When collapsed, the user may forget to pick up the detached handle.

2. When carrying bottled or canned beverage or the like in the bottle basket, the user must hold the middle part of the handle.

3. Because the handle must be disconnected from the frame structure of the bottle basket before collapsing, the packing procedure of this structure of folding collapsible bottle basket in the factory is complicated.

The present invention has been accomplished under the circumstances in view. It is the main object of the present invention to provide a folding collapsible bottle basket, which eliminates the aforesaid drawbacks. It is one object of the present invention to provide a folding collapsible bottle basket, which can easily be collapsed without detaching the handle. It is another object of the present invention to provide a folding collapsible bottle basket, which facilitates the packing procedure. It is still another object of the present invention to provide a folding collapsible bottle basket, which has the handle thereof serving as partition means to separate the holding space of the bottle basket into multiple storage spaces. To achieve these and other objects of the present invention, the folding collapsible bottle basket comprises a rectangular open top frame, the top frame having two parallel stretchers, the stretchers each having an insertion hole on the middle, a bottom frame, the bottom frame having a frame body and two sliding tracks spaced below the frame body, two side frames inserted through the gap between the frame body and sliding tracks of the bottom frame and pivoted to the top frame and moved along the sliding tracks between the operative position and the non-operative position, stop means provided at the sliding tracks and adapted for holding the side frames in the operative position, and a handle pivoted to the top frame, the handle having two straight end rod portions inserted through the insertion holes of the stretchers and respectively pivoted to two opposite short sides of the top frame and a ⊓-shaped middle handgrip portion connected between the straight end rod portions.

DETAILED DESCRIPTION OF THE PREFERRED EMBODIMENT

Figure 1:
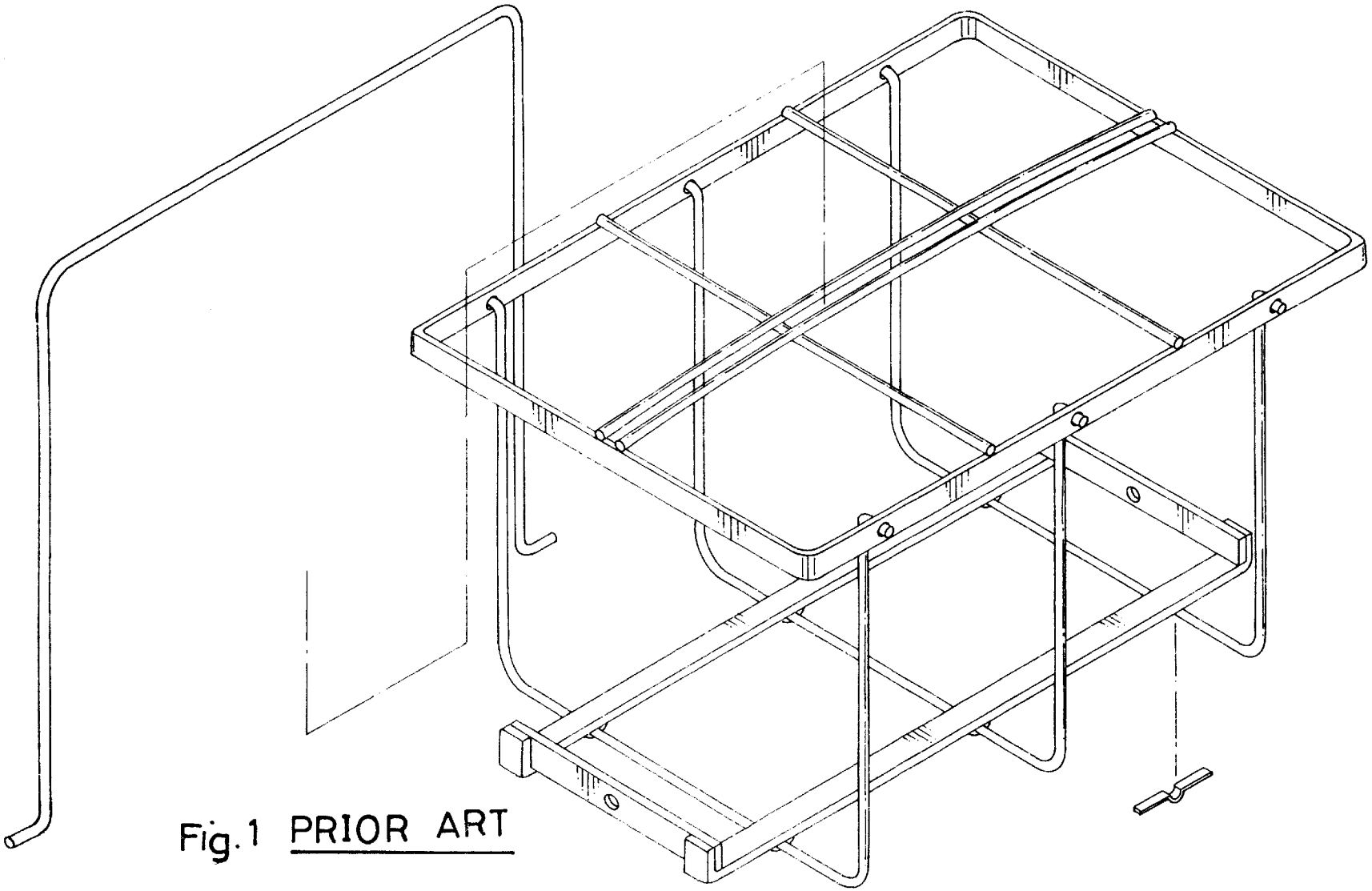
Fig. 1 PRIOR ART
FIG. 1 is an exploded view of a folding collapsible bottle basket according to the U.S. Pat. No. 6,354,455.

Referring to FIGS. from 2 through 4, a folding collapsible bottle basket in accordance with the present invention is shown comprised of a handle 1, a top frame 2, a bottom frame 3, and two side frames 4.

The handle 1 has two ends 111 pivoted to the top frame 2. The top frame 2 comprises a rectangular open frame body 21, two first pivot holes 211 symmetrically disposed in two opposite short sides of the rectangular open frame body 21 and adapted for pivotally receiving the ends 111 of the handle 1, two pairs of second pivot holes 212 symmetrically disposed in two opposite long sides of the rectangular open frame body 21 and adapted for pivotally receiving the ends of the side frames 4, two stretchers 23 connected in parallel between the two opposite long sides of the rectangular open frame body 21, two smoothly arched rod members 231 respectively fixedly fastened to the stretchers 23 and defining with the stretchers 23 a respective horizontal insertion hole 2311. The bottom frame 3 comprises an open frame body 30, and a plurality of reinforcing rods 31 welded to the top side of the open frame body 30. The side frames 4 are U-shaped rod members, each comprising a straight middle rod portion 42, two side rod portions 41 respectively extended from the ends of the straight middle rod portion 42 at right angles, and two end tips 411 respectively extended from the free ends of the side rod portions 41 at right angles in reversed directions and respectively pivoted to the second pivot holes 212 of the top frame 2.

The main features of the bottle basket are outlined hereinafter. The bottom frame 3 further comprises two parallel sliding tracks 32 disposed in parallel to and spaced below the open frame body 30 thereof and extended in direction along the long sides of the rectangular open frame body 21 of the top frame 2. The sliding tracks 32 each have two angled ends 320 respectively welded to the open frame body 30, two upright stops 321 respectively disposed adjacent to the angled ends 320, and two protrusions 322 disposed adjacent and spaced between the upright stops 321 and adapted for holding down the straight middle rod portions 42 of the side frames 4 at the upright stops 321. The side frames 4 are respectively transversely inserted through the bottom frame 3 and extended across the space between the open frame body 30 and sliding tracks 32 of the bottom frame 3, keeping the straight middle rod portions 42 movably supported on the sliding tracks 32 between the upright stops 321. The handle 1 is made of a metal wire rod having a substantially ⊓-shaped middle handgrip portion 12, and two straight end rod portions 11 respectively extended from the ends of the ⊓-shaped middle handgrip portion 12 at right angles and extended in reversed directions. The straight end rod portions 11 of the handle 1 are respectively inserted through the insertion holes 2311 of the smoothly arched rod members 231 of the top frame 2, enabling the respective ends 111 to be respectively pivoted to the first pivot holes 211 of the top frame 2. Further, the straight end rod portions 11 of the handle 1 and the stretchers 23 separate the rectangular open frame body 21 of the top frame 2 into multiple spaces for holding bottles or the like.

Figure 2:
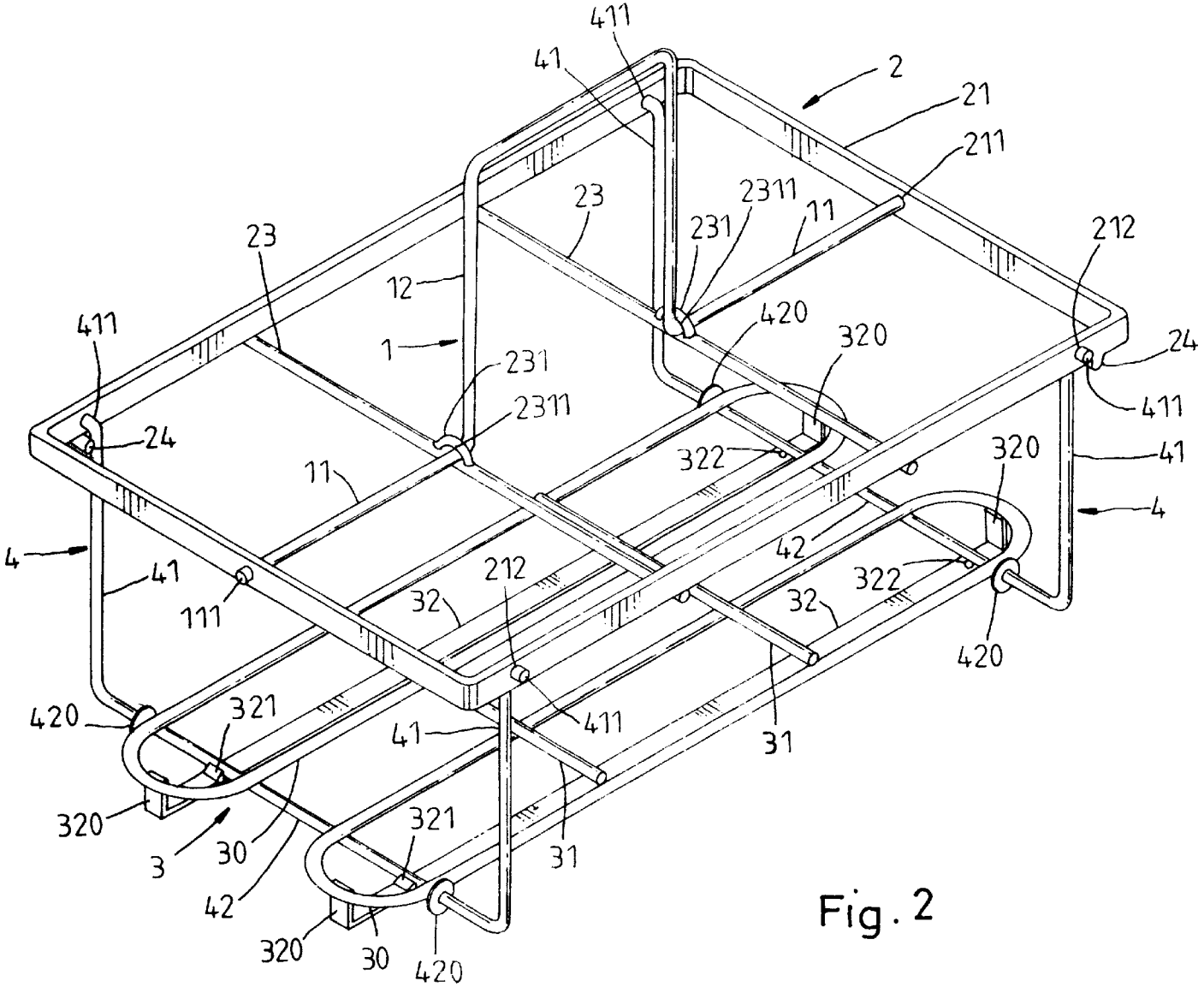
FIG. 2 is a perspective view of a folding collapsible bottle basket according to the present invention.
Figure 3:
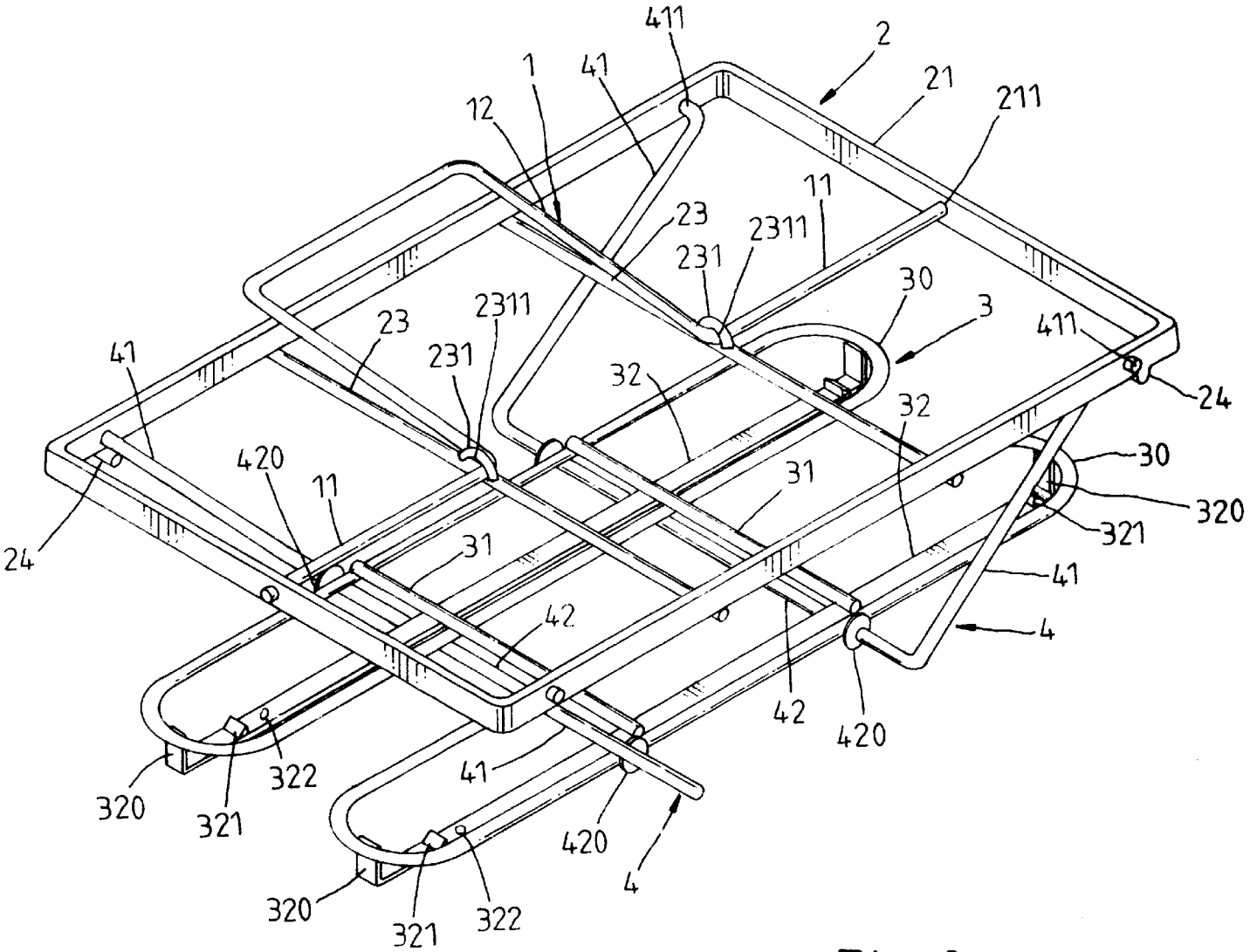
FIG. 3 illustrates the folding action of the folding collapsible bottle basket according to the present invention.
Figure 4:
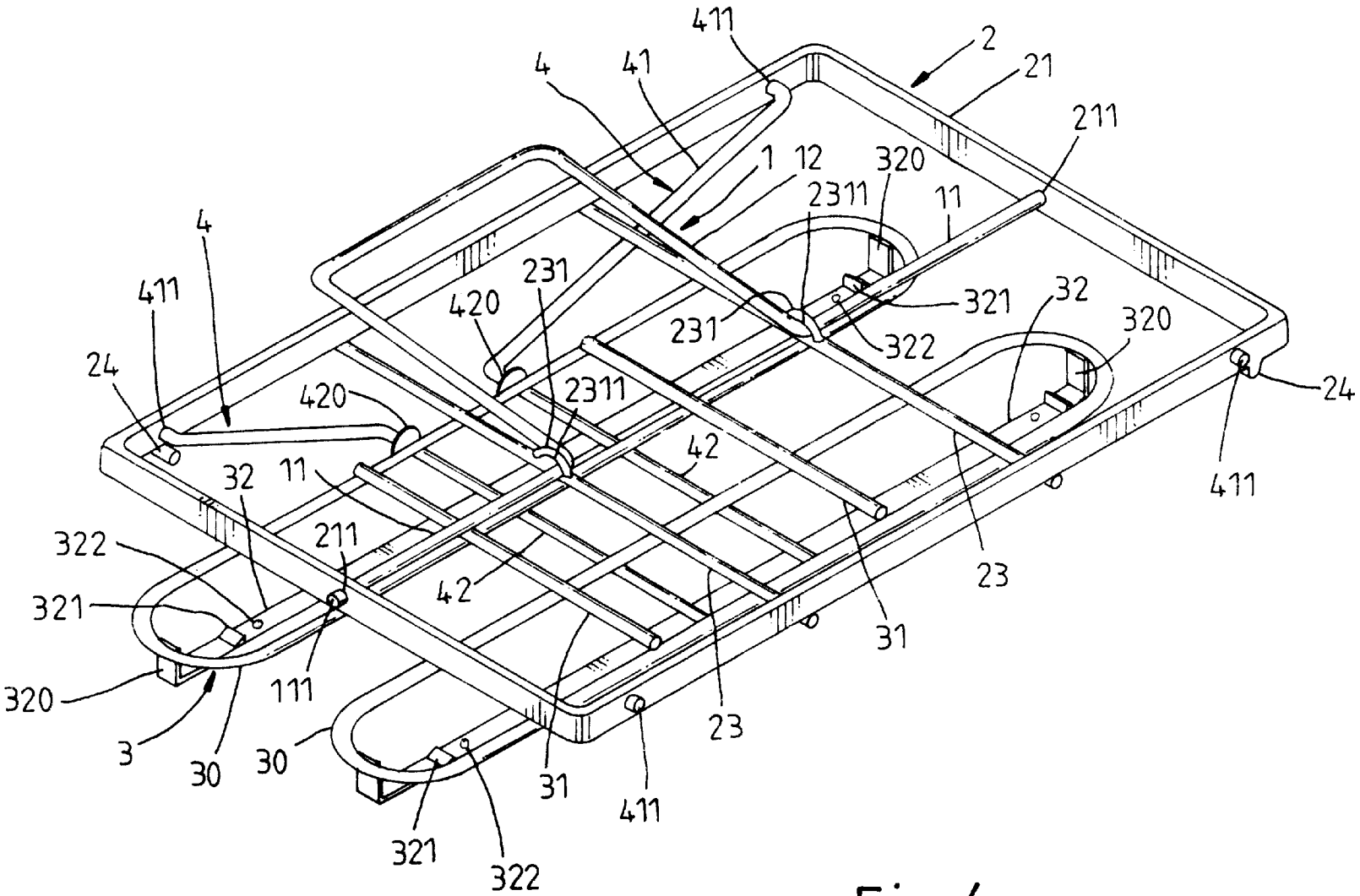
FIG. 4 illustrates the folding collapsible bottle basket collapsed according to the present invention.

When collapsing the folding collapsible bottle basket, turn the handle 1 toward one side from the operative (vertical) position shown in FIG. 2 to the non-operative (collapsed) position shown in FIG. 3, and then turn the side frames 4 inwards toward each other along the sliding tracks 32 from the operative (vertical) position shown in FIG. 2 to the non-operative (collapsed) position shown in FIGS. 3 and 4. When collapsed, as shown in FIG. 4, the handle 1 is closely attached to the top side of the top frame 2. On the contrary, when in use, the handle 1 and the side frames 4 are respectively turned from the non-operative position to the operative position, keeping the straight middle rod portions 42 of the side frames 4 at the upright stops 321 to be respectively stopped between the protrusions 322 and upright stops 321 of the sliding tracks 32. By means of turning the side frames 4 inwards toward each other with force, the straight middle rod portions 42 are disengaged from the constraint of the protrusions 322.

The top frame 2 further comprises a plurality of stop blocks 24 adapted for limiting the turning angle of the side frames 4 and prohibiting outward turning of the side frames 4. The side frames 4 each further comprises two friction members 420 respectively fixedly fastened to the respective straight middle rod portion 42 and disposed in contact with the open frame body 30 of the bottom frame 3 at two sides for guiding movement of the side frames 4 relative to the bottom frame 3 smoothly stably.

What is claimed is:

1. A folding collapsible bottle basket comprising:

a top frame, said top open frame comprising a rectangular open frame body having two opposite short sides and two opposite long sides, two first pivot holes symmetrically disposed in the two opposite short sides of the rectangular open frame body of said top frame, two pairs of second pivot holes symmetrically disposed in the two opposite long sides of the rectangular open frame body of said top frame, two stretchers connected in parallel between the two opposite long sides of the rectangular open frame body of said top frame, two smoothly arched rod members respectively fixedly fastened to said stretchers and defining with said stretchers a respective horizontal insertion hole;

a handle pivoted to the first pivot holes of said top frame;

a bottom frame, said bottom frame comprising an open frame body, and a plurality of reinforcing rods welded to a top side of the open frame body of said bottom frame; and two side frames, said side frames each comprising a straight middle rod portion, two side rod portions respectively extended from two ends of said straight middle rod portion at right angles, and two end tips respectively extended from free ends of said side rod portions at right angles in reversed directions and respectively pivoted to the second pivot holes of said top frame;

wherein:

said bottom frame further comprises two parallel sliding tracks disposed in parallel to and spaced below the open frame body of said bottom frame and extended in direction along the long sides of the rectangular open frame body of said top frame, said sliding tracks each having two angled ends respectively welded to the open frame body of said bottom frame, two upright stops respectively disposed adjacent to said angled ends, and two protrusions disposed adjacent and spaced between said upright stops and adapted for holding down the straight middle rod portions of said side frames at said upright stops;

said side frames are respectively transversely inserted through said bottom frame and extended across the space between the open frame body and said sliding tracks of said bottom frame, keeping the straight middle rod portions of said side frames movably supported on said sliding tracks between said upright stops;

said handle comprises a substantially ⊓-shaped middle handgrip portion, and two straight end rod portions respectively extended from two distal ends of said ⊓-shaped middle handgrip portion at right angles and extended in reversed directions through the insertion holes of said smoothly arched rod members of said top frame, said straight end rod portions of said handle each having a respective end respectively pivoted to the first pivot holes of said top frame.

2. The folding collapsible bottle basket as claimed in claim 1, wherein said top frame further comprises a plurality of stop blocks adapted for limiting the turning angle of said side frames and prohibiting outward turning of said side frames; said side frames each further comprises two friction members respectively fixedly fastened to the respective straight middle rod portion and disposed in contact with the open frame body of said bottom frame at two sides for guiding movement of said side frames relative to said bottom frame.

* * * * *